United States Patent [19]

Shiraishi et al.

[11] Patent Number: 4,532,878

[45] Date of Patent: Aug. 6, 1985

[54] APPARATUS FOR ABRASIVE CLEANING

[75] Inventors: Minoru Shiraishi, Kumamoto; Yoshimi Numata, Nagasu; Hiroshi Tano, Maizuru; Tatsumi Onaka, Amagasaki, all of Japan

[73] Assignee: Hitachi Zosen Corporation, Osaka, Japan

[21] Appl. No.: 568,616

[22] Filed: Jan. 6, 1984

[51] Int. Cl.[3] ..... B24B 27/00; B63B 59/00

[52] U.S. Cl. ..... 114/222; 51/174; 51/180; 15/98

[58] Field of Search ..... 15/1.7, 49 R, 49 RB, 15/50 R, 98; 51/174, 180; 114/222, 150; 308/3 R, 3 A, 4 R, 6 B; 180/274, 277, 275; 273/2, 5

[56] References Cited

U.S. PATENT DOCUMENTS

| | | | |
|---|---|---|---|
| 1,077,217 | 10/1913 | Brunswick | 293/5 |
| 1,100,316 | 6/1914 | Masterson | 293/5 |
| 2,697,447 | 12/1954 | Troy | 251/32 |
| 2,883,244 | 4/1959 | Berger | 308/6 B |
| 3,088,429 | 5/1963 | Johannessen | 114/222 |
| 3,496,681 | 2/1970 | Oswald | 15/49 R |
| 3,922,991 | 12/1975 | Woods | 114/222 |
| 3,946,692 | 3/1976 | Sierra et al. | 15/49 R |
| 3,971,091 | 7/1976 | Peren et al. | 15/49 A |
| 3,994,539 | 11/1976 | Gottlieb | 308/3 A |
| 4,024,597 | 5/1977 | Fouracre | 15/28 |
| 4,146,107 | 3/1979 | Ebbeson et al. | 180/275 |
| 4,365,573 | 12/1982 | Jamieson | 114/150 |
| 4,445,451 | 5/1984 | van den Broek | 114/222 |

FOREIGN PATENT DOCUMENTS 58-59555 4/1983 Japan .

*Primary Examiner*—Trygve M. Blix
*Assistant Examiner*—Edwin L. Swinehart
*Attorney, Agent, or Firm*—Joseph W. Farley

[57] ABSTRACT

An abrasive cleaning apparatus comprising a truck adapted to run on the first surface to be cleaned, a first abrasive cleaner adapted to be pressed against the first surface and mounted on the truck by a first support assembly so as to be limitedly movable in the direction of a first axis substantially perpendicular to the first surface and and limitedly tiltable in every direction with respect to the first axis, and a second abrasive cleaner adapted to be pressed against the second surface to be cleaned and substantially perpendicular to the first surface and mounted on the truck by a second support assembly so as to be limitedly movable in the direction of a second axis substantially parallel to the first surface and to be limitedly tiltable in every direction with respect to the second axis. The apparatus is suited to use in ships and like structures including two members welded together at a right angle to each other for simultaneously cleaning the surfaces of the members by abrasion in the vicinity of the welded portion, especially when the surfaces have projections or undulations.

9 Claims, 5 Drawing Figures

APPARATUS FOR ABRASIVE CLEANING

FIELD OF THE INVENTION

The present invention relates to an abrasive cleaning apparatus for simultaneously cleaning two surfaces which are positioned at a right angle with each other, and more particularly to a self-running abrasive cleaning apparatus for use in ships and like structures including two members welded together at a right angle for abrading the surfaces of the members in the vicinity of the welded portion to automatically remove oxides formed on the surfaces by welding.

DESCRIPTION OF RELATED ART

Published Unexamined Japanese Utility Model application No. 58-59555 discloses an abrasive cleaning apparatus of this type. The disclosed apparatus comprises a truck adapted to run on the floor surface of a ship, a first abrasive cleaner mounted on the truck by first support means limitedly movable and having at its one end a first abrasive cleaning tool adapted to contact the floor surface, first biasing means for pressing the first abrasive cleaner against the floor surface, a second abrasive cleaner mounted on the truck by second support means limitedly movable and having at its one end a second abrasive cleaning tool adapted to contact a longitudinal member welded to the floor perpendicular thereto, and second biasing means for pressing the second abrasive cleaner against the longitudinal member. The first support means includes a holder rotatably supported at an intermediate portion thereof by a horizontal pin whose position is adjustable by an adjusting assembly in directions perpendicular and parallel to the floor. The first abrasive cleaner is fixed to one end of the holder. The first biasing means comprises a compression spring, which biases the other end of the holder to press the first abrasive cleaner, i.e., the first abrasive cleaning tool, into contact with the floor surface. The second support means is similar to the first support means in construction. A third abrasive cleaner is further mounted on the truck by third support means for cleaning the welded portion between the floor and the longitudinal member by abrasion. The third abrasive cleaner is pressed against the welded portion by third biasing means. The third support means is also similar to the first and second support means in construction.

With the abrasive cleaning apparatus of the above construction, each abrasive cleaner is rotatable about the horizontal pin (which is fixed in position after adjustment), so that the abrasive cleaner can pass over a projection on the floor or the longitudinal member while rotating about the horizontal pin to a position above the floor or the longitudinal member. However, since the abrasive cleaner is rotatable only in a direction at right angles with the horizontal pin, the apparatus is unable to hold the cleaning tool in full contact with the floor solely by the rotation of the cleaner about the horizontal pin when the floor or the longitudinal member has an undulation, consequently resulting in uneven cleaning. Further when the tool of the abrasive cleaner is held in face-to-face contact with the floor or the longitudinal member, the abrasive cleaner actually encounters difficulty in rotating about the horizontal pin and therefore in passing over projections.

SUMMARY OF THE INVENTION

An object of the present invention is to provide an abrasive cleaning apparatus which is free of the foregoing problem of the conventional apparatus.

To fulfill this object, the present invention provides an apparatus for abrasive cleaning comprising a truck adapted to run on the first surface to be cleaned, a first abrasive cleaner limitedly movably mounted on the truck by first support means and having at its one end a first abrasive cleaning tool adapted to contact the first surface, first biasing means for pressing the first abrasive cleaner against the first surface, a second abrasive cleaner limitedly movably mounted on the truck by second support means and having at its one end a second abrasive cleaning tool adapted to contact the second surface to be cleaned and substantially perpendicular to the first surface, and second biasing means for pressing the second abrasive cleaner against the second surface. The apparatus is characterized in that the first and second abrasive cleaners are supported by the first and second support means so as to be limitedly movable in the directions of first and second axes substantially perpendicular to the first and second surfaces, respectively, and to be limitedly tiltable in every direction with respect to the first and second axes, respectively.

Since each abrasive cleaner of the above apparatus is movable in the direction of an axis substantially perpendicular to the corresponding surface to be cleaned, the cleaner easily passes over projections on the surface. In addition to this feature, the abrasive cleaner is tiltable in every direction with respect to the axis, so that even when the surface to be cleaned has complicated undulations, the cleaning tool can be held in full contact with the surface at all times to assure cleaning without unevenness.

Various features and advantages of the present invention will be readily understood from the embodiment to be described below with reference to the accompanying drawings.

DESCRIPTION OF THE PREFERRED EMBODIMENT

Figure 1:
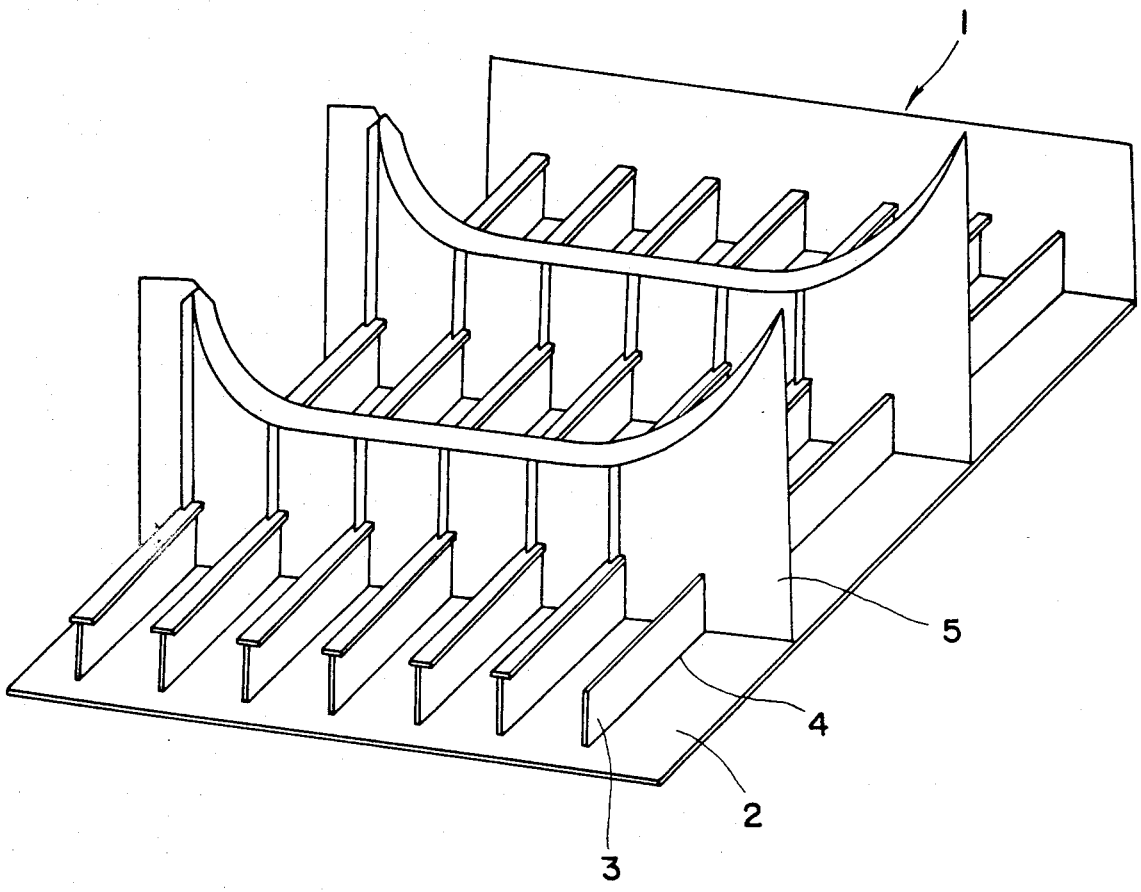
FIG. 1 is a perspective view showing part of a ship as an example of the structure to be cleaned by abrasion.

With reference to FIG. 1 showing a ship as an example of the structure to be cleaned by abrasion, indicated at 1 is a portion of the ship. The portion 1 has a floor 2, to which vertical longitudinal members 3 are welded as at 4. Transverse members 5 perpendicular to the longitudinal members 3 and also to the floor 2 are welded to the floor. The abrasive cleaning apparatus of the invention is suitable for cleaning the floor 2 and the longitudinal member 3 in the vicinity of the welded portion 4 and has the following construction.

Figure 2:
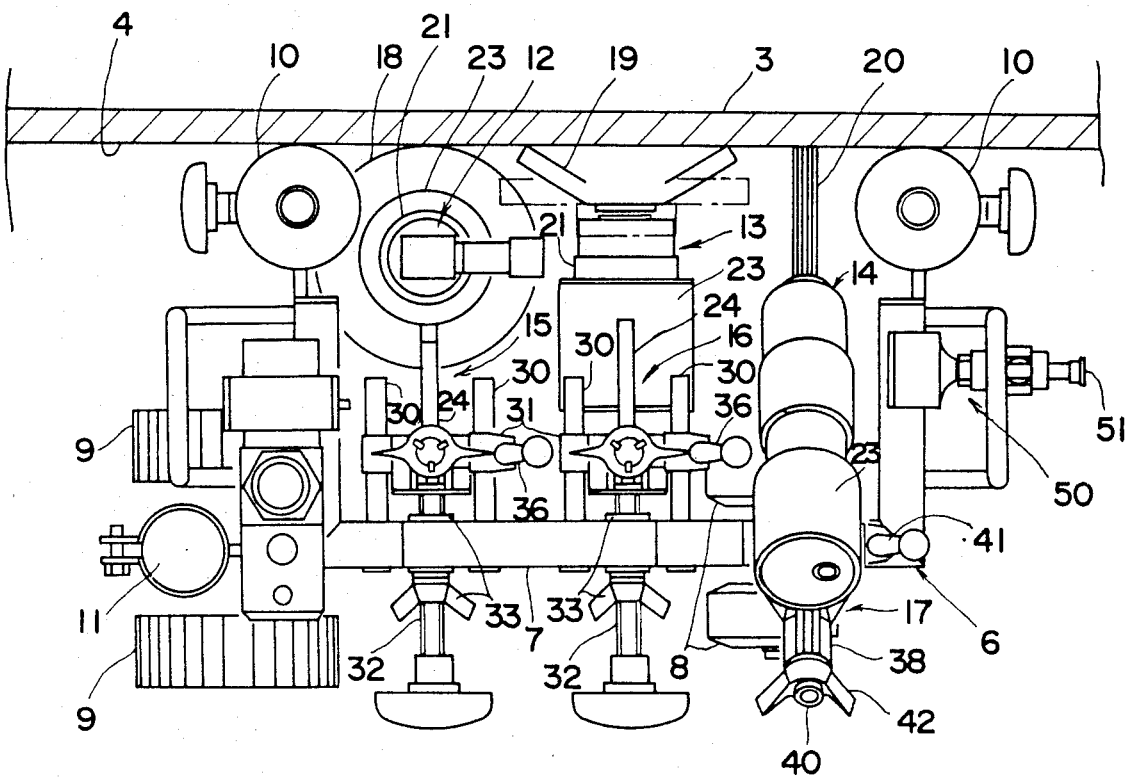
FIG. 2 is a plan view showing an abrasive cleaning apparatus embodying the invention.
Figure 3:
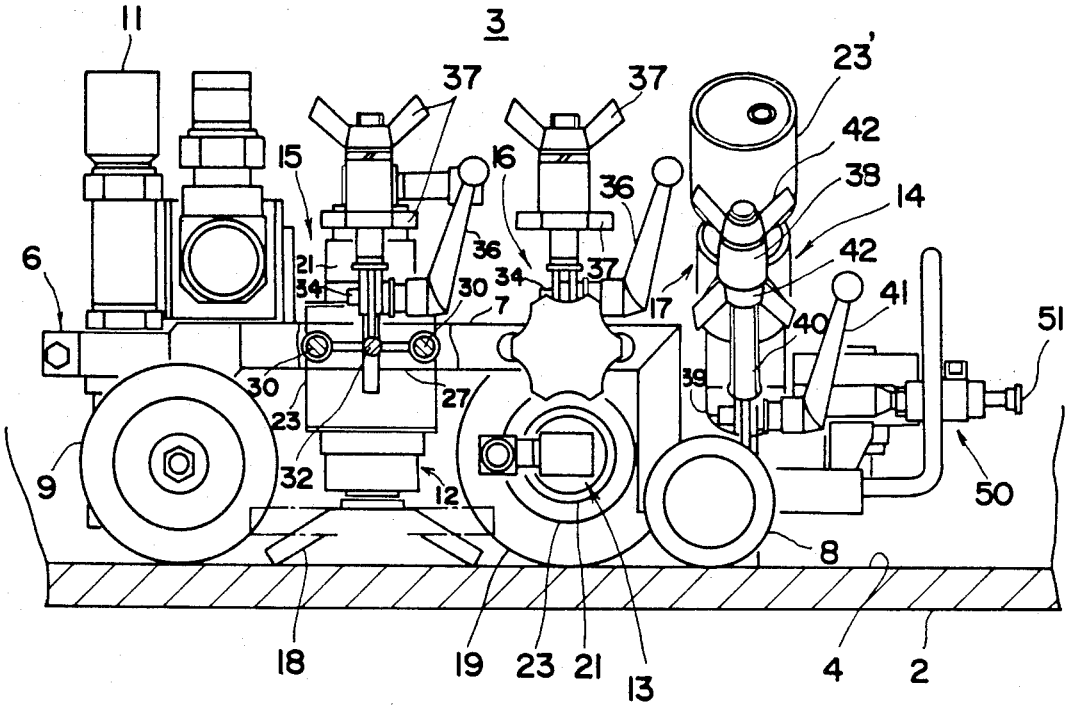
FIG. 3 is a side elevation of the apparatus.
Figure 4:
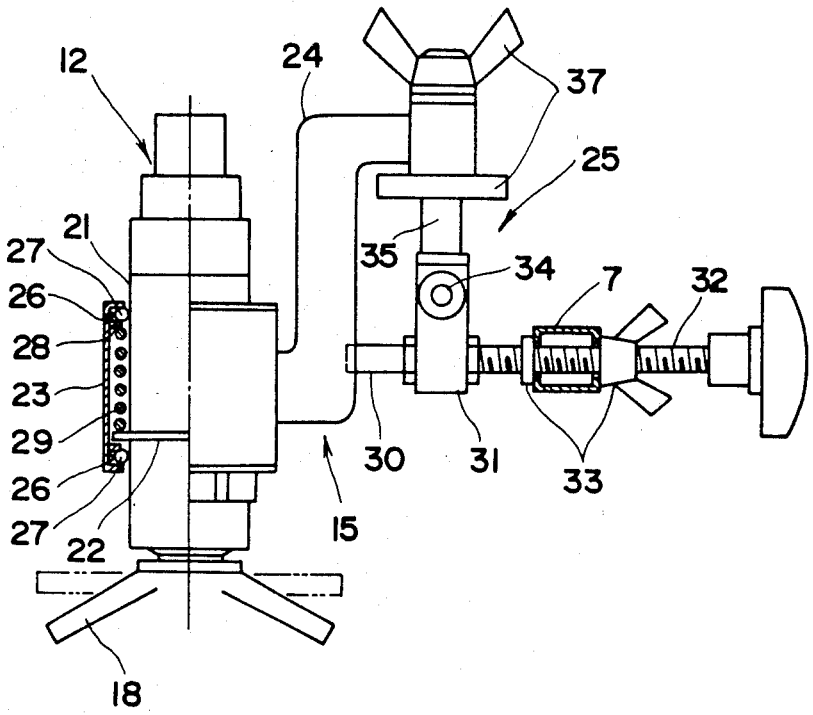
FIG. 4 is a fragmentary side elevation partly in section and showing the apparatus.

Referring to FIGS. 2 to 4, a truck 6 adapted to run on the floor 2 has a pair of wheels 8 and another pair of wheels 9 at front and rear portions of a frame 7 respectively. Magnet rollers 10 attractable by the longitudinal member 3 are mounted on the truck 6 at one side thereof adjacent the longitudinal member 3. The truck 6 is adapted to run on the floor 2 at a specified spacing from the longitudinal member 3 when the rear wheels 9 are driven by a pneumatic truck drive motor 11. First, second and third abrasive cleaners 12, 13 and 14 are mounted on the truck 6 by first, second and third support means 15, 16 and 17. The first abrasive cleaner is disposed perpendicular to the floor 2 and has at its one end a wire brush 18 serving as a first abrasive cleaning tool and adapted to contact the floor surface 2 in the vicinity of the welded portion 4. The second abrasive cleaner 13 is positioned perpendicular to the longitudinal member 3 and has at its one end a wire brush 19 serving as a second abrasive cleaning tool and adapted to contact the surface of the longitudinal member 3 in the vicinity of the welded portion 4. The third abrasive cleaner 14 is in an inclined position with respect to the truck 6 and has at its one end needles 20 providing a third abrasive cleaning tool and adapted to contact the surface of the welded portion 4.

The first abrasive cleaner 12 includes a main body 21 having a substantially cylindrical outer surface and an annular flange 22 around the cleaner main body 21. The first support means 15 consists essentially of a holding cylinder 23 surrounding the cleaner main body 21 with a gap formed therebetween, a holding arm 24 fixed at its one end to the holding cylinder 23, and a position adjusting assembly 25. An annular channel portion 26 is formed at each of the opposite ends of the holding cylinder 23. The channel portion 26 has retained therein guide balls 27 having a diameter larger than the depth of the portion 26 and limitedly movable radially of the holding cylinder 23. Accordingly the abrasive cleaner 12 is limitedly tiltable within the holding cylinder 23 in every direction with respect to an axis perpendicular to the floor surface 2. A compression spring 29 for pressing the cleaner 12, i.e., the first abrasive cleaning tool 18, against the floor 2 is provided between the annular flange 22 on the cleaner main body 21 and a wall member 28 defining one of the annular channels 26 of the holding cylinder 23.

The position adjusting assembly 25 comprises guide rods 30 extending from the truck frame 7 in parallel with the floor 2 and a movable frame 31 slidably mounted on the guide rods 30. A screw rod 32 extending through the truck frame 7 is attached at its one end to the movable frame 31. The horizontal position of the movable frame 31 is adjustable by moving a pair of nuts 33 screwed on the screw rod 32 at opposite sides of the truck frame 7. A screw rod 35 is pivoted to the movable frame 31 by a horizontal pin 34. The position of the screw rod 35 moved about the pin 34 can be fixed by a clamp 36. The other end of the holding arm 24 is loosely fitted to the screw rod 35. The vertical position of the holding arm 24 is adjustable by moving a pair of nuts 37 screwed on the screw rod 35 at opposite sides of the other end of the arm 24.

The second abrasive cleaner 13 and the second support means 16 are similar to the first abrasive cleaner 12 and the first support means 15, respectively, except that the cleaner main body 21 and holding cylinder 23 are perpendicular to the longitudinal member 3 and that the holding arm 24 is differently shaped, so that each corresponding part is referred to by the same reference numeral concerned without giving a further description.

Like the first support means 15, the third support means 17 also includes a holding cylinder 23' having the third abrasive cleaner 14 loosely inserted therethrough. A connecting ring 38 fixed to a side portion of the holding cylinder 23' is loosely fitted to a screw rod 40 which is rotatably connected to the truck 6 by a horizontal pin 39. The position of the screw rod 40 about the pin 39 can be fixed by a clamp 41. The position of the connecting ring 38 on the screw rod 40 can be fixed by a pair of nuts 42 screwed on the rod 40 at opposite sides of the connecting ring 38. The third abrasive cleaner 14 is supported by the holding cylinder 23' in the same manner as already described.

The abrasive cleaning apparatus of the invention has the following pneumatic circuit.

Figure 5:
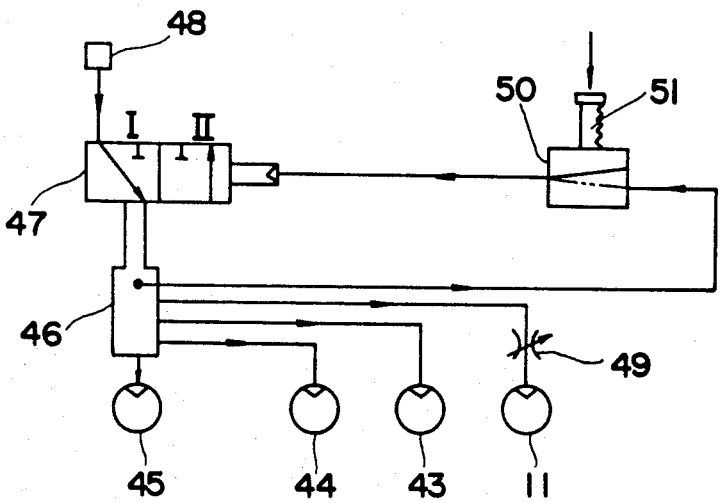
FIG. 5 is a schematic diagram showing a pneumatic circuit useful for the apparatus.

With reference to FIG. 5, the pneumatic truck drive motor 11, and first, second and third pneumatic cleaner drive motors 43, 44, 45 (not shown in FIGS. 2 to 4) incorporated in the first to third abrasive cleaners 12, 13, 14 can be connected to an air supply source 48 by way of a distributor 46 and a pilot valve 47. Provided between the distributor 46 and the truck drive motor 11 is a flow rate control valve 49, which, when adjusted, controls the running speed of the truck 6. The pilot valve 47 is operated by a normally closed change-over valve 50. When the change-over valve 50 is in the normally closed state illustrated, the pilot valve 47 is in its open position I, supplying pressurized air from the supply source 48 to all the motors 11, 43, 44, 45 to drive the truck 6 and perform an abrasive cleaning operation as desired. The change-over valve 50 is attached to a front portion of the truck 6 (FIGS. 2 and 3) and has an operating member 51 projecting from the front portion of the truck 6. When the operating member 51 is pushed in, the change-over valve 50 is opened, and is held opened by a locking mechanism (not shown). Accordingly, when the truck 6 approaches the transverse member 5 (FIG. 1) during travel, the operating member 51 is pushed in by the member 5, and the change-over valve 50 is held opened. Consequently the pilot valve 47 is brought into closed position II to discontinue the supply of air to all the motors 11, 43, 44, 45. The truck 6 resumes travel for abrasive cleaning operation when the change-over valve 50 is unlocked.

What is claimed is:

1. An apparatus for abrasive cleaning comprising a truck adapted to run on a first surface and along a second surface substantially perpendicular to the first surface, a first abrasive cleaner mounted on the truck by first support means substantially perpendicularly to the first surface and having at its one end a first abrasive cleaning tool adapted to contact the first surface, first biasing means for pressing the first abrasive cleaner against the first surface, a second abrasive cleaner mounted on the truck by second support means substantially perpendicularly to the second surface and having at its one end a second abrasive cleaning tool adapted to contact the second surface, and second biasing means for pressing the second abrasive cleaner against the second surface, wherein each abrasive cleaner comprises a main body having a substantially cylindrical outer surface, and the corresponding support means includes a holding cylinder surrounding the main body outer surface and provided at each of its opposite ends with inwardly directed annular flange means to define an adjoining annular channel, a gap being formed between the flange means and the main body outer surface, the annular channel radially movably retaining therein guide balls having a diameter larger than the depth of the annular channel and adapted to contact the main body outer surface, the difference between the ball diameter and the channel depth being smaller than said gap, whereby the first and second abrasive cleaners are supported by the first and second support means so as to be limitedly movable in the direction of first and second axes substantially perpendicular to the first and second surfaces, respectively, and so as to be limitedly tiltable in every direction with respect to the first and second axes, respectively.

2. An apparatus as defined in claim 1 further comprising a third abrasive cleaner mounted on the truck by third support means and having at its one end a third abrasive cleaning tool adapted to contact a welded portion formed between the two surfaces to be cleaned, and third biasing means for pressing the third abrasive cleaner against the welded portion, the third abrasive cleaner being supported by the third support means so as to be limitedly movable along a third axis extending toward the welded portion and to be limitedly tiltable in every direction with respect to the third axis.

3. An apparatus as defined in claim 1 wherein each of the support means includes a position adjusting assembly adapted to adjust the position of the corresponding abrasive cleaner in directions perpendicular and parallel to the corresponding surface to be cleaned and to adjust the rotated position of the corresponding abrasive cleaner about an axis parallel to the two surfaces to be cleaned.

4. An apparatus as defined in claim 2 wherein the third support means includes a position adjusting assembly adapted to adjust the position of the third abrasive cleaner in the direction of the third axis and to adjust the rotated position of the third abrasive cleaner about an axis parallel to the two surfaces to be cleaned.

5. An apparatus as defined in claim 2 wherein each of the first and second abrasive cleaning tools comprises a wire brush, and the third abrasive cleaning tool comprises needles.

6. An apparatus as defined in claim 2 wherein a fluid drive motor for operating the truck and fluid drive motors for operating the abrasive cleaners are connected to a working fluid supply source by way of a pilot valve openable or closable by a change-over valve.

7. An apparatus as defined in claim 6 wherein the change-over valve comprises a normally closed valve having a locking function and provided with an operating member projecting from the front end of the truck, and the change-over valve is opened by the operating member being pushed in during travel of the truck by a collision surface upstanding from the first surface to be cleaned to discontinue the supply of working fluid to the fluid drive motors by way of the pilot valve.

8. An apparatus as defined in claim 1 wherein the truck is provided with magnet rollers attractable by the second surface to be cleaned.

9. An apparatus as defined in claim 2 wherein said third abrasive cleaner comprises a main body having a substantially cylindrical outer surface, and said third support means includes a holding cylinder surrounding the third abrasive cleaner main body with a gap formed therebetween and having an annular channel portion at each of its opposite ends, each annular channel portion radially movably retaining therein guide balls having a diameter larger than the depth of the annular channel portion and adapted to contact the third abrasive cleaner main body outer surface, the difference between the ball diameter and the channel depth being smaller than said gap.

* * * * *